US007540836B2

(12) United States Patent
Schall et al.

(10) Patent No.: US 7,540,836 B2
(45) **Date of Patent: *Jun. 2, 2009**

(54) DRIVE FOR A CYLINDER OF A ROTARY PRESS

(75) Inventors: Nils-Hendric Schall, Augsburg (DE); Andreas Stieler, Augsburg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 752 days.

This patent is subject to a terminal disclaimer.

(21) Appl. No.: 10/723,779

(22) Filed: Nov. 24, 2003

(65) Prior Publication Data

US 2004/0168589 A1 Sep. 2, 2004

(30) Foreign Application Priority Data

Nov. 26, 2002 (DE) ..... 102 55 235

(51) Int. Cl.
*B31F 1/08* (2006.01)

(52) U.S. Cl. ..... 493/424; 493/476; 493/428; 493/432

(58) Field of Classification Search ..... 493/424, 493/429, 476, 428, 432; 270/37, 38, 42, 270/45

See application file for complete search history.

(56) References Cited

U.S. PATENT DOCUMENTS 4,279,410 A * 7/1981 Bolza-Schunemann ..... 270/6
4,352,671 A * 10/1982 Petersen ..... 493/424
5,443,437 A * 8/1995 Mack ..... 493/359
5,507,714 A * 4/1996 Furuta et al. ..... 493/475
5,610,491 A 3/1997 Gotz et al.
5,637,072 A * 6/1997 Michaelis ..... 493/476
5,676,630 A 10/1997 Mayr
5,901,647 A * 5/1999 Kohlmann ..... 101/216
5,979,317 A * 11/1999 Singler ..... 101/218
6,004,242 A * 12/1999 Kostiza ..... 475/341
6,398,704 B1 * 6/2002 Shibuya et al. ..... 493/424
6,487,965 B2 * 12/2002 Stieler et al. ..... 101/216
6,752,751 B2 * 6/2004 Jackson et al. ..... 493/428
6,846,279 B2 * 1/2005 Stieler et al. ..... 493/424
7,011,617 B2 * 3/2006 Sappal et al. ..... 493/424
2002/0119877 A1 8/2002 Jackson et al.

FOREIGN PATENT DOCUMENTS

DE 44 26 987 A1 1/1996
EP 1 234 794 A2 2/2002

* cited by examiner

*Primary Examiner*—Sameh H. Tawfik
(74) *Attorney, Agent, or Firm*—Cohen Pontani Lieberman & Pavane LLP

(57) ABSTRACT

In the drive for cylinders of a rotary press which operate together, one of the cylinders includes a pair of cylinder segments which can be driven and rotated independently of one another by respective electric motors. The further cylinder is driven by a dedicated electric motor.

15 Claims, 4 Drawing Sheets

DRIVE FOR A CYLINDER OF A ROTARY PRESS

BACKGROUND OF THE INVENTION

1. Field of the Invention

The invention relates to a drive for a cylinder of a rotary press, which has cylinder segments which can be driven and rotated independently of one another.

2. Description of the Related Art

U.S. Pat. No. 5,676,630 shows a drive for folding cylinders of a folder of a rotary press, in detail a blade cylinder, a pin folding blade cylinder, a folding jaw cylinder and a gripper cylinder having a drive connection via spur gears and being driven mechanically in series. The pin folding blade cylinder and the folding jaw cylinder are in each case configured as two-part cylinders, as they are known, that is to say they comprise cylinder segments which are nested in each other and can be rotated with respect to each other. The cylinder segments bear systems, for example folding blades or folding jaws, which, in the event of an adjustment of the folder, can be adjusted in terms of their circumferential spacing from adjacent systems. In this way, for example, the pre-fold can be adjusted or a format adjustment can be carried out. The adjustment of the cylinder segments is carried out by means of planetary gear mechanisms.

In the case of this folder, the outlay on mechanisms is high. In addition, rotational flank play in the drive adds up.

U.S. 2002/119,877 likewise shows a folder, in the case of which the pin folding blade cylinder and the folding jaw cylinder have mutually rotatable cylinder segments. The cylinder segment bearing the pins is driven by a dedicated motor, and the cylinder segment bearing the folding blades and the cylinder segment bearing the folding jaws are driven by a further motor, the two latter segments having a drive connection via spur gears. This drive is also subject to an outlay on mechanisms.

SUMMARY OF THE INVENTION

It is an object of the invention to provide a mechanically simple drive for cylinders having mutually rotatable segments.

According to the invention, the cylinder operates together with a further cylinder which is driven by a dedicated electric motor. It is possible for the drive to dispense with cylinder gears, as a result of which rotational flank play is minimized. With the cylinder, operations can be carried out appropriately accurately, for example with a folding cylinder, folds can be carried out accurately, the pre-fold can be set and implemented accurately. Folding differences are minimized decisively as a result of the angular position of the functional groups in relation to one another, which can be maintained with high accuracy. Moreover, if drive gear wheels are dispensed with, it is possible to dispense with an encapsulated lubrication system.

The accuracy of the synchronism between the functional groups and thus the operating accuracy are increased considerably in steady-state and dynamic terms by using an electronic, virtual line shaft for the electric motors for predefining position and rotational speed. Adjustments can be set flexibly, rapidly and highly accurately by electronically predefining an angular offset between the functional groups.

The proposed drive brings about a reduction in the masses which are connected in series and never rotate ideally, in the never ideal mechanical contact points and in the disturbances associated with these. Because of the reduction in the masses connected in series, the mechanical contact points and the associated compliances, an increase in the torsional stiffness in the individual functional groups is achieved. Disturbances, for example as a result of blade and folding impacts, in the individual functional groups are decoupled. There is an increase in the stiffness with regard to disturbances/a reduction in the susceptibility with respect to disturbances from, for example, blade and folding impacts, because of the stiffer connection between the motor and the location of the disturbance, and therefore sharper control. The lower complexity and higher stiffness of the separated functional groups makes the use of periodic and adaptive compensation controllers possible, with which an increase in the stiffness with respect to disturbances/a reduction in the susceptibility with respect to disturbances is feasible. Overall, therefore, an increase in the accuracy of the synchronous running between the functional groups and therefore, for example, a considerable increase in the cutting and folding accuracy is possible in the case of application to folding cylinders.

The drive makes the assessment of motor/drive control variables possible, such as motor current and control differences, with which, for example, the mechanical wear of cutting and folding blades can be assessed.

By means of mechanical end stops, hardware limit switches or software limit switches, safeguarding against drive disturbances is readily possible.

The drive makes use of elements of simple design and can therefore be produced cost-effectively.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
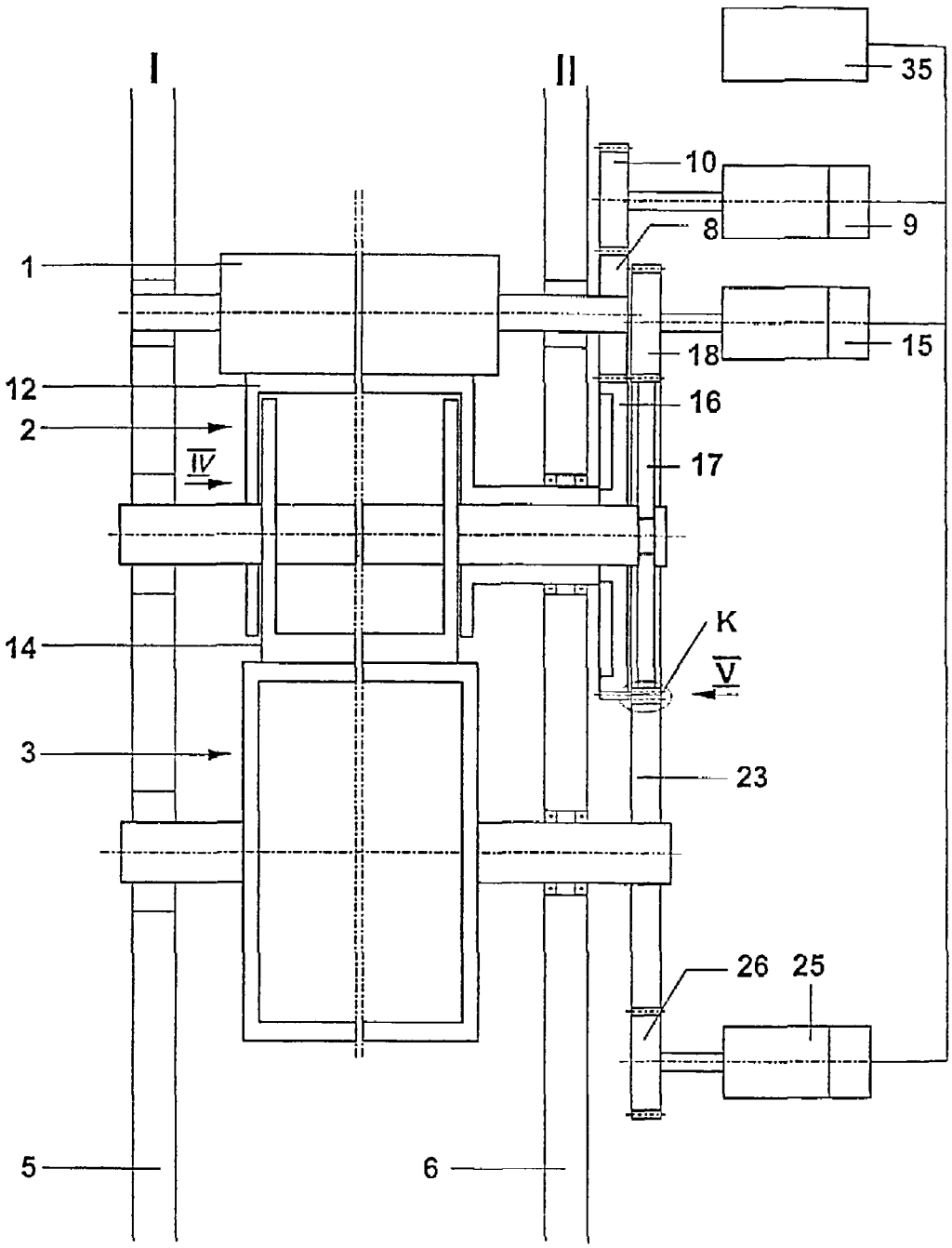
FIG. 1 is a schematic plan view of the drive of a folder.
Figure 2:
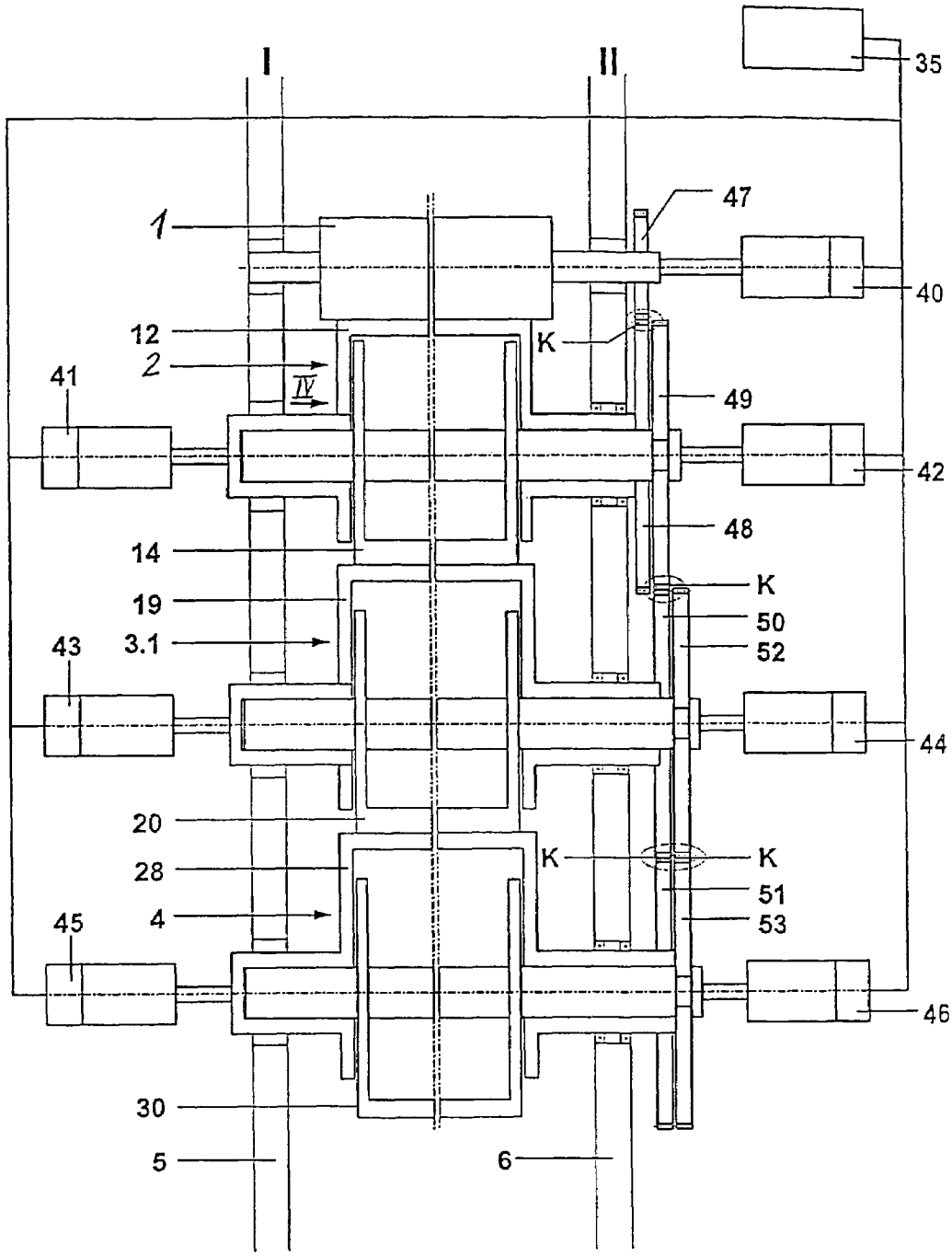
FIG. 2 is a schematic plan view of a further exemplary embodiment of the drive of a folder.

FIG. 1 shows a folder in an extended arrangement of its cylinders and drive gears. In detail, the folder contains a knife cylinder 1, a folding cylinder 2 and a folding jaw cylinder 3. The cylinders are mounted in side walls 5, 6. The knife cylinder 1 is, for example, fitted with two mutually opposite cutting knives 7. The cutting knives 7 and the working elements 11, 13 and 21 (described below) of the cylinders 2 and 3 can be seen in FIG. 3, irrespective of the fact that FIG. 3, as a side view of the further exemplary embodiment according to FIG. 2, shows a folding jaw cylinder 3,1 comprising segments, and additionally a gripper folding blade cylinder 4. A spur gear 8, in which an electric motor 9 engages with its pinion 10, is fixed to a journal of the knife cylinder 1.

The folding cylinder 2 comprises a cylinder segment 12 bearing holding elements 11 and a further cylinder segment 14 bearing folding blades 13. The cylinder segments 12, 14 are, for example, designed in three parts, that is to say they bear three holding elements 11 or folding blades 13 offset through 120°. The cylinder segments 12, 14 can be rotated with respect to one another. In addition, they can be driven independently of one another and therefore each have a drive connection to a dedicated drive motor 9, 15. For this purpose, a spur gear 16, 17 is fixed to each cylinder segment 12, 14. The spur gear 16 of the gear segment 12 is engaged with the spur gear 8 and is therefore driven indirectly via the latter by the electric motor 9, which engages with its pinion 10 in the spur gear 8. Likewise, the electric motor 9 could engage with its pinion 10 in the spur gear 16. The electric motor 15 engages with its pinion 18 in the spur gear 17 of the further cylinder segment 14.

The folding jaw cylinder 3 operates together with the folding cylinder 2. The former is, for example, designed in three parts and bears three folding jaw systems 21 uniformly distributed on its circumference. The folding jaw cylinder 3 is driven by a dedicated electric motor 25. For this purpose, its journal bears a spur gear 23, in which the pinion 26 of the electric motor 25 engages.

Although the teeth of the spur gears 17 and 23 of the cylinder segment 14 and of the folding jaw cylinder 3 engage in one another, the spur gears 17 and 23 do not have a drive connection while the folder is operating. A spacing s is in each case present between the flanks of the meshing teeth (FIG. 5), so that there is rotational flank play of ± s between the spur gears 17, 23. Advantageously, the spacing s is in the range 0.2 mm≦s≦0.8 mm. The rotational flank play 2 s can advantageously be achieved by negative profile displacement of one or both spur gears, for example by a profile displacement of approximately −0.5 in total. Instead of this, it is also possible to define the tooth thickness tolerances in a correspondingly large play range. In addition to their drive function for the associated cylinder 2, 3, the spur gears 17, 23 have the task of providing collision protection. If the rotational angle position of one or both cylinders 2, 3 were to deviate from a desired position by more than a permissible rotational angle, the folding blade 13 would not enter the folding jaw 21 when the cylinder segment 14 is in rolling contact with the folding jaw cylinder 3, with the destruction of these parts and possibly further parts as the consequence. Therefore, the spur gears 17, 23 limit the rotatability of the cylinders 2, 3, in that their tooth flanks come into contact when the limit value is reached. Instead of the spur gears 17, 23, it is also possible to provide other elements which ensure the rotational positions of the cylinder segment 14 and of the folding jaw cylinder 3 relative to one another, for example tooth segments or keys and key seats.

A web 33, which can already have been longitudinally folded, for example by means of a folding former, is fed to the folding cylinder 2 by perforating devices and pull rolls (not described in greater detail). The function of the folder can also be seen from FIG. 3, as it coincides with the function of the folder shown there up to the formation of the first cross fold. In interplay with the folding cylinder 2, the cutting knives 7 of the knife cylinder 2 cut the web 33 into products 34, which are picked up by the holding elements 11 of the folding cylinder, for example pins. During this interplay between the knife cylinder 1 and the folding cylinder 2, the knife cylinder 1 and the cylinder segment 12 bearing the holding elements 11 have a drive connection via their spur gears 8, 16 and are driven by the electric motor 9. The cylinder segment 14 is driven synchronously with the cylinder segment 12 by means of the electric motor 15, which engages with its pinion 18 in the spur gear 17 of the further cylinder segment 14. The electric motors 9 and 15, and also the electric motor 25, are synchronous motors, which are driven with position control via an electronic, virtual line shaft, as is known. Drives of this type are familiar to those skilled in the art and described, for example, in U.S. Pat. No. 5,610,491. Asynchronous motors or other highly accurate motors can also be used.

In a manner not shown, the product 34, which has been longitudinally folded and cross-folded once, is transported away, for example by means of a conveyor belt, or passed into a paddle wheel. The manufacture of a product 34 using the present cylinders 1 and 3 is known to the person skilled in the art, apart from the drive of the cylinders, and therefore does not need to be described in greater detail. More detailed explanations are given, for example, in U.S. Pat. No. 5,676,630.

For adjustment of the folder, for example for a pre-fold adjustment, the folding blade 13 has to be rotated with respect to the holding elements 11. This is carried out by means of a temporary leading or lagging operation of the electric motor 15 with respect to the electric motor 9, as a result of which the angular position of the electric motor 15 in relation to the electric motor 9 is changed. In a corresponding way, the cylinder segment 14 with its folding blades 13 is rotated with respect to the cylinder segment 12 with the holding elements 11. During this adjustment, the position of the folding jaw cylinder 3 also has to be changed, so that the folding jaws 21 come to lie opposite the folding blades 13 during operation together with the folding jaw cylinder 3. The position of the folding jaw cylinder 3 is changed by means of the motor 25, which is temporarily operated so as to lead or lag.

The angular positions to be set on the electric motors 15 and 25 for the desired positioning of the cylinder segment 14 with the folding blade 13 and, respectively, the cylinder 3 with the folding blades 21, and also positions of the electric motor 9, are stored in a computing and storage unit 35. This is connected to the input of the motor control system of the electric motors 9, 15, 25. For an adjustment of the aforesaid elements, the desired angular positions are called up by the computing and storage unit 35 and predefined to the motor control system of the electric motors 9, 15, 25. Instead of this, it is also possible to enter the desired adjustments manually at the control desk of the printing press.

Figure 4:
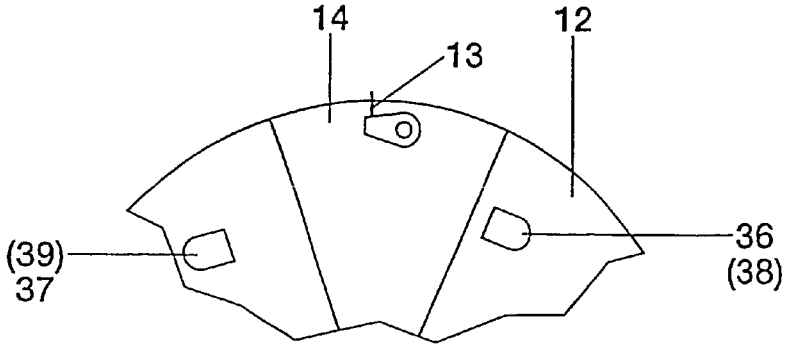
FIG. 4 shows the view IV from FIGS. 1 and 2.

Fitted to the cylinder segment 12 are two stops 36, 37, which limit the mutual rotatability of the cylinder segments 12 and 14. Instead of or in conjunction with the mechanical stops 36, 37, hardware limit switches, for example limit switches 38, 39, can also be used. Limit switches 38, 39 of this type are also specified in FIG. 4, placed in brackets. As a further possible safeguard, the position control system of the electric motors 9, 15 contains desired limiting values for their mutual angular offset, which provides a limitation on the mutual rotatability of the cylinder segments 12 and 14.

Figure 3:
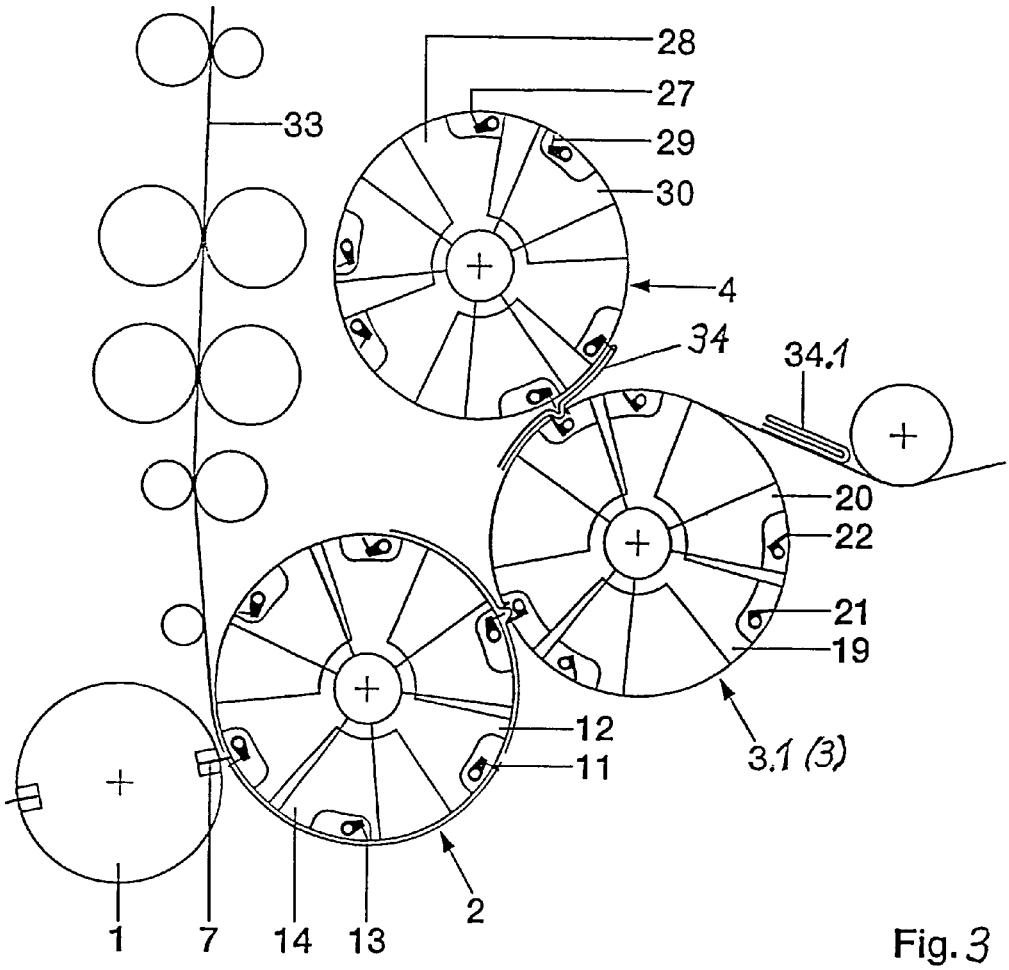
FIG. 3 shows the folder according to FIG. 2 in side view.

FIG. 2 shows a folder in an extended arrangement of its cylinders and drive gears. For reasons of simplicity, the reference symbols are provided with the suffix "0.1" or retained where components broadly coincide with the previous exemplary embodiment. In detail, the folder contains a knife cylinder 1, a folding cylinder 2, a folding jaw cylinder 3.1 and a gripper folding blade cylinder 4. The cylinders are mounted in side walls 5, 6. The knife cylinder 1 is, for example, fitted with two mutually opposite cutting knives 7 (FIG. 3). The knife cylinder 1 is driven by a motor 40 which is directly connected to the knife cylinder 1.

The folding cylinder 2 comprises a cylinder segment 12 bearing holding elements 11 and a further cylinder segment 14 bearing folding blades 13. The cylinder segments 12, 14 are, for example, designed in three parts, that is to say they bear three holding elements 11 or folding blades 13 offset through 120°. The cylinder segments 12, 14 can be rotated with respect to one another. In addition, they can be driven independently of one another and therefore each have a direct drive connection to a dedicated electric motor 41, 42.

The folding jaw cylinder 3.1 operates together with the folding cylinder 2. The former in turn comprises two cylinder segments 19, 20, the cylinder segment 19 bearing folding jaws 21 and the further cylinder segment 20 bearing folding jaws 22. The cylinder segments 19, 20 are, for example, in each case designed in three parts, so that they each bear three folding jaw systems 21, 22. The cylinder segments 19, 20 can be rotated with respect to one another and driven independently of one another. For this purpose, each cylinder segment 19, 20 has a drive connection to a dedicated electric motor 43, 44.

The gripper folding blade cylinder 4 operates together with the folding jaw cylinder 3.1. The former contains a cylinder segment 28 bearing grippers 27 and a further cylinder segment 30 bearing folding blades 29, which segments can be rotated with respect to one another and driven independently of one another, and for this purpose each have a drive connection to a dedicated electric motor 45, 46.

Figure 5:
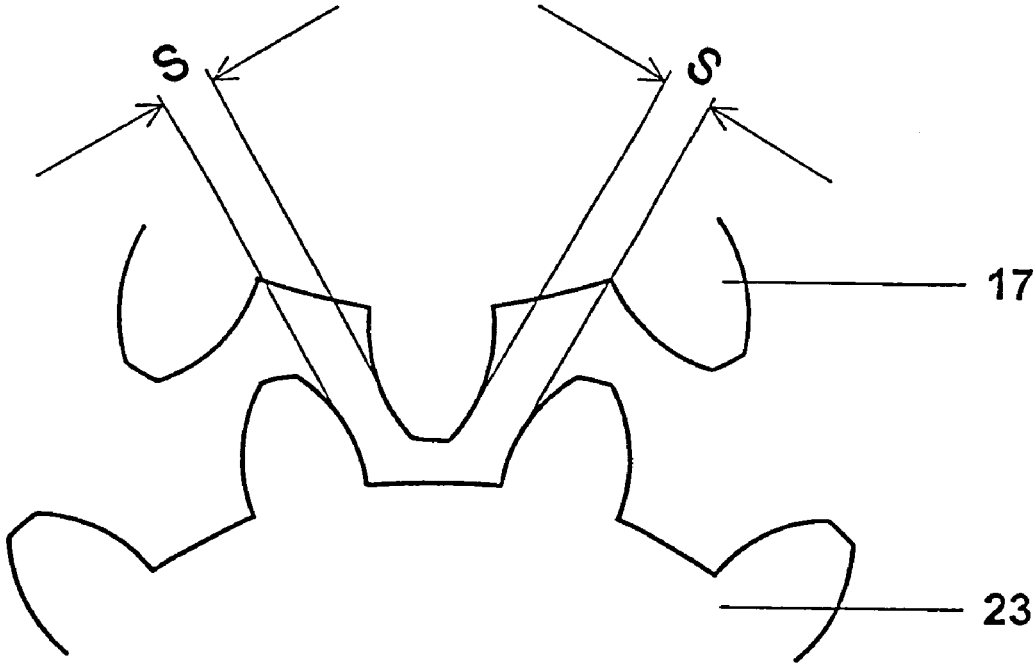
FIG. 5 shows the view V from FIG. 1.

The cylinder segments and/or cylinders which in each case operate together and are driven in each case by a dedicated drive are provided in each case with a collision protection means, as shown in FIG. 5 with respect to the previous exemplary embodiment. In detail, the knife cylinder 1 and the cylinder segment 12, the cylinder segment 14 and the cylinder segment 19, the cylinder segment 19 and the cylinder segment 28 and also the cylinder segment 20 and the cylinder segment 30 are provided with in each case one spur gear 47 and 48, 49 and 50, 50 and 51, and 52 and 53, respectively, which spur gears respectively operate together with rotational flank play. The positions of engagement for the purpose of collision protection are shown in FIG. 3 (and in FIG. 2) by an item K in each case. The spur gears 47 to 53 have no drive function and their tooth flanks do not roll along one another during normal operation. Therefore, the spur gears 47 to 53 do not need to have dimensions suitable for great torques and can be made, for example, from plastic. A lubricating-oil system can also be dispensed with for this reason, and expensive oil encapsulation of the folder is rendered superfluous.

A web 33, which can already have been folded longitudinally, for example by means of a folding former, is fed to the folding cylinder 2 via perforating devices and pull rolls (not described in greater detail). In interplay with the folding cylinder 2, the cutting knives 7 of the knife cylinder 1 cut the web 33 into products 34, which are picked up by the holding elements 11 of the folding cylinder, for example pins.

During the onward rotation of the folding cylinder 2, the product 34 on the folding cylinder 2 is transferred by the folding blade 13 into a folding jaw 21 of the folding jaw cylinder 3.1, a cross fold being produced. The product is transferred from the folding jaw 21 to the grippers 27 of the cylinder segment 28 of the gripper folding blade cylinder 4. The product is transferred, with a second cross fold being made in the process, from the folding blades 29 into the folding jaws 22 of the folding jaw cylinder 3.1, the product 34.1 with two cross folds being produced which is finally transported away by the folding jaw cylinder 3.1. The manufacture of the product 34.1 using the present cylinders 1, 2, 3.1 and 4 is known to the person skilled in the art, apart from the drive of the cylinders, and therefore does not need to be described in greater detail. More detailed explanations are given, for example, in U.S. Pat. No. 5,676,630.

The electric motors 40 to 46 are synchronous motors, which are driven with position control via an electronic, virtual line shaft, as is known, and in this way implement the required positions of the cylinder segments and/or cylinders driven by them. Drives of this type are familiar to those skilled in the art and described, for example, in U.S. Pat. No. 5,610,491. Asynchronous motors or other highly accurate motors can also be used. In the case of direct connection as shown here, the electric motors 40 to 46 can also advantageously be designed as torque motors.

For adjustments of the folder, for example for a pre-fold adjustment, the folding blade 13 has to be rotated with respect to the holding elements 11. This is carried out by means of a temporary leading or lagging operation of the electric motor 42 with respect to the electric motor 41, as a result of which the angular position of the electric motor 42 in relation to the electric motor 41 is changed. In a corresponding way, the cylinder segment 14 with its folding blades 13 is rotated with respect to the cylinder segment 12 with the holding elements 11. For this purpose, the folding jaw 21 of the cylinder segment 19 is then rotated by means of the motor 43 so as to match the folding blade 13.

On the same principle, the position of the second cross fold produced by the folding blade 29 can also be changed with respect to the first cross fold. The electric motor 46 is temporarily operated so as to lead or lag, depending on whether the second cross fold is to be produced closer to the first cross fold or further away from the latter. In this way, the angular position of the cylinder segment 30 bearing the folding blade 29 is changed with respect to the cylinder segment 19 driven by the electric motor 43 and bearing the folding jaw 21. For this purpose, the folding jaw 22 of the cylinder segment 20 is then rotated by means of the motor 44 so as to match the folding blade 29.

The angular positions to be set on the electric motors 41 to 46 for the desired positioning of the cylinder segments 12,14, 19, 20, 28, 30, and also positions of the electric motor 40, are stored in a computing and storage unit 35. This is connected to the input of the motor control system of the electric motors 40 to 46. For an adjustment of the aforesaid elements, the desired angular positions are called up by the computing and storage unit 35 and predefined to the motor control system of the electric motors 40 to 46. Instead of this, it is also possible to enter the desired adjustments manually at the control desk of the printing press.

Fitted to the cylinder segment 12 are two stops 36, 37, which limit the mutual rotatability of the cylinder segments 12 and 14. Stops of this type are also present on the folding jaw cylinder 3.1 and the gripper folding blade cylinder 4, in order to limit the mutual rotatability of the cylinder segments 19, 20 and 28, 30. Instead of or in conjunction with the mechanical stops 36, 37, hardware limit switches, for example limit switches 38, 39, can also be used. Limit switches 38, 39 of this type are also specified in FIG. 4, placed in brackets. As a further possible safeguard, the position control system of the electric motors 40 to 46 contains desired limiting values for their mutual angular offset, which provides a limitation on the mutual rotatability of the cylinder segments 12, 14, 19, 20, 28, 30.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A rotary press comprising:

a first cylinder having a pair of cylinder segments which can be rotated independently of each other;

a pair of electric motors connected to respective said cylinder segments by respective drive connections so that said cylinder segments can be driven independently of one another;

a second cylinder;

a dedicated electric motor which drives said second cylinder synchronously with said first cylinder, the dedicated electric motor driving only said second cylinder; and means for limiting deviation of at least one of said cylinders and said cylinder segments from a desired rotational position, said means for limiting deviation comprising rotation-limiting spur gears fixed to said second cylinder and at least one of said cylinder segments, said rotation-limiting spur gears each having teeth with tooth flanks, said rotation-limiting spur gears meshing with rotational flank play and without said tooth flanks touching one another during operation so that there is no drive connection between the rotation-limiting spur gears during operation, wherein the first cylinder is a folding cylinder and said pair of cylinder segments comprise first and second cylinder segments which can be rotated independently of each other, said first cylinder segment bearing holding elements, said second cylinder segment bearing folding blades, and wherein said second cylinder is a folding jaw cylinder.

2. A rotary press as in claim 1 further comprising:

a further cylinder;

a first spur gear fixed to said further cylinder a second spur gear fixed to one of said cylinder segments of said first cylinder and having a drive connection to said first spur gear fixed to said further cylinder.

3. A rotary press as in claim 1 further comprising:

a further cylinder which rotates synchronously with said first cylinder, said further cylinder having a pair of cylinder segments which can be rotated independently of each other; and a pair of electric motors connected to respective said cylinder segments of said further cylinder by respective drive connections so that said cylinder segments of said further cylinder can be driven independently of one another, at least one of said pair of electric motors driving only one of said cylinder segments of said further cylinder.

4. A rotary press as in claim 1 wherein said folding jaw cylinder comprises first and second cylinder segments which each bear folding jaws and can rotate relative to each other, each of said cylinder segments of said folding jaw cylinder being driven by a respective said dedicated electric motor so that said cylinder segments of said folding jaw cylinder can be driven independently of one another, said press further comprising:

a gripper folding blade cylinder comprising a first cylinder segment bearing grippers and a second cylinder segment bearing folding blades; and a pair of electric motors connected to respective said cylinder segments of said gripper folding blade cylinder by respective drive connections so that said cylinder segments of said gripper folding blade cylinder can be driven independently of one another, at least one of said pair of electric motors driving only one of said cylinder segments of said gripper folding blade cylinder.

5. A rotary press as in claim 1 further comprising:

a knife cylinder;

a first spur gear fixed to said knife cylinder;

a second spur gear fixed to one of said cylinder segments of said folding cylinder and having a drive connection to said first spur gear fixed to said knife cylinder; and a pinion connected to said electric motor driving said first segment of said folding cylinder, said pinion engaging one of said first and second spur gears.

6. A rotary press as in claim 1 further comprising:

a knife cylinder; and an electric motor which drives said knife cylinder synchronously with said folding cylinder.

7. A rotary press as in claim 1 further comprising a motor control system for presetting the angular positions of the driven cylinders, said motor control system comprising a computing and storage unit in which said angular positions are stored, said computing and storage unit having an input side connected to said electric motors.

8. A rotary press as in claim 1 wherein said cylinder segments of each said cylinder having segments comprise stops which limit relative rotation of said cylinder segments.

9. A rotary press as in claim 1 wherein said cylinder segments of each said cylinder having segments comprise hardware limit switches which limit relative rotation of said cylinder segments.

10. A rotary press as in claim 1 further comprising a position control system for said electric motors, said position control system containing desired limiting values for limiting the mutual rotatability of the cylinder segments and the cylinders.

11. A rotary press as in claim 1 wherein at least one of said electric motors is configured as a torque motor.

12. A rotary press as in claim 1 further comprising a motor control system for presetting the angular positions of the driven cylinders, said motor control system comprising a computing and storage unit in which said angular positions are stored, said computing and storage unit having an input side connected to said electric motors.

13. A rotary press as in claim 1 wherein said cylinder segments of each said cylinder having segments comprise stops which limit relative rotation of said cylinder segments.

14. A rotary press as in claim 1 wherein said cylinder segments of each said cylinder having segments comprise hardware limit switches which limit relative rotation of said cylinder segments.

15. A rotary press as in claim 1 further comprising a position control system for said electric motors, said position control system containing desired limiting values for limiting the mutual rotatability of the cylinder segments and the cylinders.

* * * * *